US007154488B2

(12) United States Patent
Morita

(10) Patent No.: US 7,154,488 B2
(45) Date of Patent: Dec. 26, 2006

(54) DRIVER CIRCUIT, ELECTRO-OPTICAL DEVICE, AND DRIVE METHOD

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 410 days.

(21) Appl. No.: 10/714,875

(22) Filed: Nov. 18, 2003

(65) Prior Publication Data

US 2004/0140969 A1 Jul. 22, 2004

(30) Foreign Application Priority Data

Nov. 21, 2002 (JP) ..... 2002-337909

(51) Int. Cl.
*G09G 5/00* (2006.01)

(52) U.S. Cl. ..... 345/204; 345/98; 345/99; 345/100

(58) Field of Classification Search ..... 345/204, 345/98–99, 100
See application file for complete search history.

(56) References Cited

U.S. PATENT DOCUMENTS 6,333,729 B1 * 12/2001 Ha ..... 345/98
6,518,708 B1 * 2/2003 Aso ..... 315/169.1
6,566,643 B1 5/2003 Morita

* cited by examiner

*Primary Examiner*—Richard Hjerpe
*Assistant Examiner*—Leonid Shapiro
(74) *Attorney, Agent, or Firm*—Oliff & Berridge, PLC

(57) ABSTRACT

A display panel includes a plurality of scanning lines; a plurality of signal lines, each of the signal lines transmitting a multiplexed data signal for first to third color components; a plurality of pixels, each of the pixels being connected with one of the scanning lines and one of the signal lines; and a plurality of demultiplexers, each of the demultiplexers including first to third demultiplex switching elements which are respectively switch-controlled based on first to third demultiplex control signals, one end of each of the first to third demultiplex switching elements being connected with one of the signal lines and the other end of each of the first to third demultiplex switching elements being connected with one of the pixels for a j-th color component ($1 \leqq j \leqq 3$, j is an integer). A gate signal corresponding to shift output obtained by shifting a start pulse signal which is generated when at least two of the first to third demultiplex control signals go active at the same time is output to each of the scanning lines.

12 Claims, 12 Drawing Sheets

DRIVER CIRCUIT, ELECTRO-OPTICAL DEVICE, AND DRIVE METHOD

Japanese Patent Application No. 2002-337909 filed on Nov. 21, 2002, is hereby incorporated by reference in its entirety.

BACKGROUND OF THE INVENTION

The present invention relates to a driver circuit, an electro-optical device, and a drive method.

A display panel (electro-optical device in a broad sense) represented by a liquid crystal display (LCD) panel is used as a display section of various information instruments. There has been a demand for reduction of the size and weight of the information instrument and an increase in the image quality. Therefore, reduction of the size of the display panel and reduction of the pixel size have been demanded. As one solution to satisfy such a demand, a method of forming a display panel by using a low temperature polysilicon (hereinafter abbreviated as "LTPS") process has been studied.

BRIEF SUMMARY OF THE INVENTION

One aspect of the present invention relates to a driver circuit for driving an electro-optical device, wherein the electro-optical device comprises:

a plurality of scanning lines;

a plurality of signal lines, each of the signal lines transmitting a multiplexed data signal for first to third color components;

a plurality of pixels, each of the pixels being connected with one of the scanning lines and one of the signal lines; and a plurality of demultiplexers, each of the demultiplexers including first to third demultiplex switching elements which are respectively switch-controlled based on first to third demultiplex control signals, one end of each of the first to third demultiplex switching elements being connected with one of the signal lines and the other end of each of the first to third demultiplex switching elements being connected with one of the pixels for a j-th color component ($1 \leqq j \leqq 3$, j is an integer), wherein the driver circuit comprises a gate signal generation circuit which outputs a gate signal to each of the scanning lines, the gate signal corresponding to shift output obtained by shifting a start pulse signal, and wherein the gate signal generation circuit comprises a start pulse signal generation circuit which generates the start pulse signal on condition that at least two of the first to third demultiplex control signals go active at the same time.

Another aspect of the present invention relates to an electro-optical device comprising:

a plurality of scanning lines;

a plurality of signal lines, each of the signal lines transmitting a multiplexed data signal for first to third color components;

a plurality of pixels, each of the pixels being connected with one of the scanning lines and one of the signal lines; and a plurality of demultiplexers, each of the demultiplexers including first to third demultiplex switching elements which are respectively switch-controlled based on first to third demultiplex control signals, one end of each of the first to third demultiplex switching elements being connected with one of the signal lines and the other end of each of the first to third demultiplex switching elements being connected with one of the pixels for a j-th color component ($1 \leqq j \leqq 3$, j is an integer); and a gate signal generation circuit which outputs a gate signal corresponding to shift output obtained by shifting a start pulse signal to each of the scanning lines, wherein the gate signal generation circuit comprises a start pulse signal generation circuit which generates the start pulse signal on condition that at least two of the first to third demultiplex control signals go active at the same time.

A further aspect of the present invention relates to a drive method for driving an electro-optical device, wherein the electro-optical device comprises:

a plurality of scanning lines;

a plurality of signal lines, each of the signal lines transmitting a multiplexed data signal for first to third color components;

a plurality of pixels, each of the pixels being connected with one of the scanning lines and one of the signal lines; and a plurality of demultiplexers, each of the demultiplexers including first to third demultiplex switching elements which are respectively switch-controlled based on first to third demultiplex control signals, one end of each of the first to third demultiplex switching elements being connected with one of the signal lines and the other end of each of the first to third demultiplex switching elements being connected with one of the pixels for a j-th color component ($1 \leqq j \leqq 3$, j is an integer), and wherein the method comprises:

generating a start pulse signal on condition that at least two of the first to third demultiplex control signals go active at the same time; and outputting a gate signal corresponding to shift output obtained by shifting the start pulse signal to each of the scanning lines.

DETAILED DESCRIPTION OF THE EMBODIMENT

Figure 1:
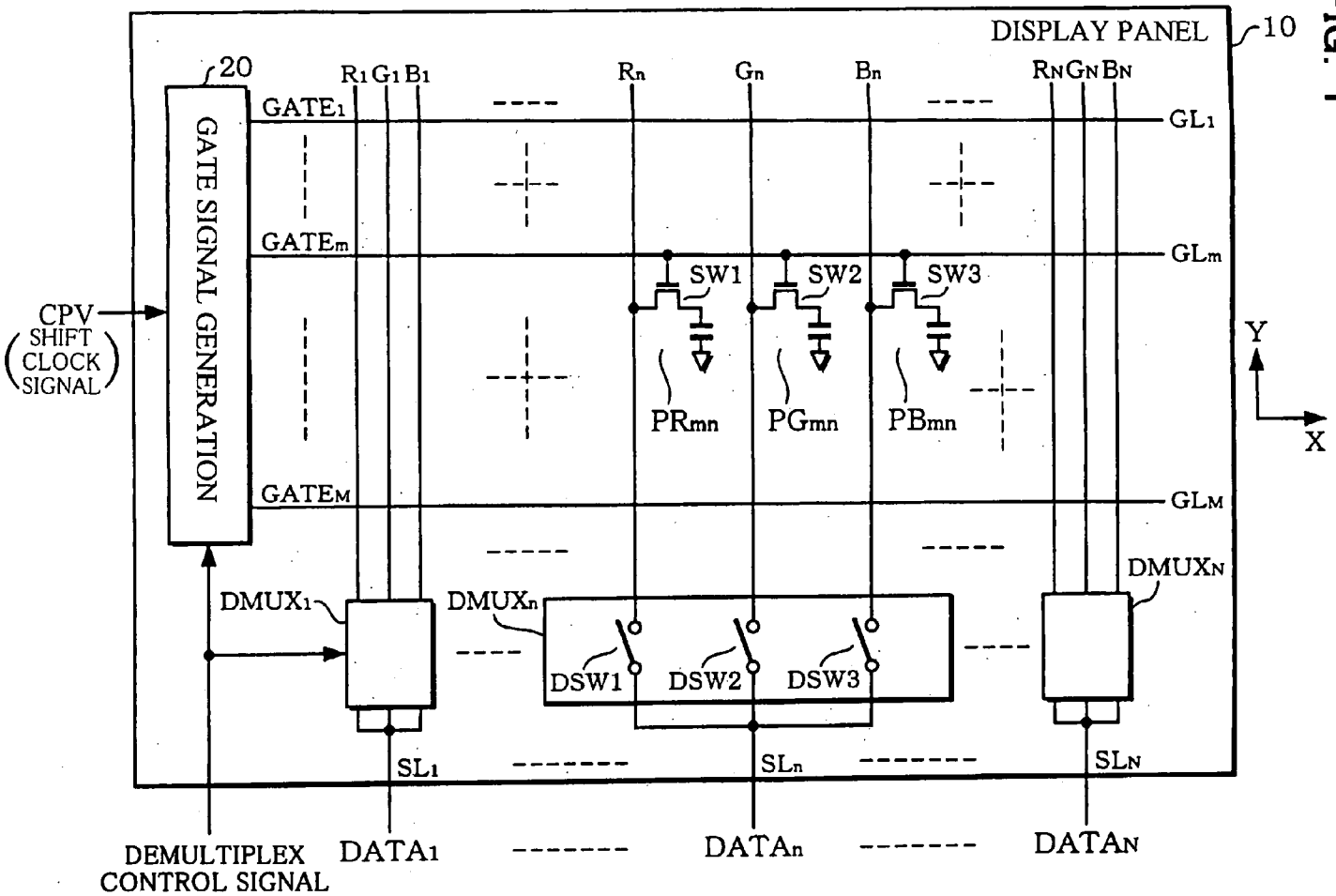
FIG. 1 is a diagram schematically showing a configuration of a display panel according to an embodiment of the present invention.

Embodiments of the present invention are described below. Note that the embodiments described hereunder do not in any way limit the scope of the invention defined by the claims laid out herein. Note also that all of the elements to be described hereunder should not be taken as essential requirements to the present invention.

According to the LTPS process, a driver circuit and the like can be directly formed on a panel substrate (glass substrate, for example) on which pixels including a switching element (thin film transistor (TFT), for example) and the like are formed. This enables the number of parts to be decreased, whereby the size and weight of the display panel can be reduced. Moreover, LTPS enables the pixel size to be reduced by applying a conventional silicon process technology while maintaining the aperture ratio. Furthermore, LTPS has high charge mobility and small parasitic capacitance in comparison with amorphous silicon (a-Si). Therefore, a charging period of the pixel formed on the substrate can be secured even if the pixel select period per pixel is reduced due to an increase in the screen size, whereby the image quality can be improved.

In a display panel in which the TFT is formed by using LTPS, the entire drivers (driver circuits) which drive the display panel can be formed on the panel. However, this results in a problem relating to reduction of the size or an increase in the speed in comparison with the case where an IC is mounted on a silicon substrate. Therefore, a method of forming a part of the functions of the drivers on the display panel has been studied.

A display panel may be provided with a demultiplexer which connects one signal line with one of R, G, and B signal lines which can be connected with pixel electrodes for R, G, and B (first to third color components). In this case, display data for R, G, and B is transmitted on the signal line by time division by utilizing the high charge mobility of LTPS. The display data for each color component is consecutively and selectively output to the R, G, and B signal lines by the demultiplexer in the select period of the R, G, and B pixels, and written in the pixel electrodes provided for each color component. According to this configuration, the number of terminals for outputting the display data to the signal line from the driver can be reduced. Therefore, it is possible to deal with an increase in the number of signal lines due to reduction of the pixel size without being restricted by the pitch between the terminals.

However, it is desirable to reduce the number of terminals of the display panel in the case of further reducing the power consumption of the entire device including the driver and the display panel. In this case, the number of signals transmitted between the display panel and the driver must be reduced without causing the image quality of the display panel to deteriorate.

According to the following embodiments, a driver circuit for an electro-optical device capable of reducing the number of terminals without causing the image quality to deteriorate when the electro-optical device and the driver circuit are formed on a single substrate, an electro-optical device, and a drive method of driving the same can be provided.

The embodiments of the present invention are described below in detail with reference to the drawings.

The following description is given taking a display panel (liquid crystal panel) in which a TFT is formed as a switching element by using LTPS as an example of an electro-optical device. However, the present invention is not limited thereto.

FIG. 1 shows an outline of a configuration of a display panel in the present embodiment. A display panel (electro-optical device in a broad sense) 10 in the present embodiment includes a plurality of scanning lines (gate lines), a plurality of signal lines (data lines), and a plurality of pixels. The scanning lines and the signal lines are disposed to intersect. The pixels are specified by the scanning lines and the signal lines.

In the display panel 10, the pixels are selected by each of the scanning lines (GL) and each of the signal lines (SL) in units of three pixels. A color component signal which is transmitted through one of three color component signal lines (R, G, B) corresponding to the signal line is written in each selected pixel. Each of the pixels includes a TFT and a pixel electrode.

In the display panel 10, the scanning lines and the signal lines are formed on a panel substrate such as a glass substrate. In more detail, a plurality of scanning lines $GL_1$ to $GL_M$ (M is an integer of two or more) which are arranged in the Y direction and extend in the X direction, and a plurality of signal lines $SL_1$ to $SL_N$ (N is an integer of two or more) which are arranged in the X direction and extend in the Y direction are disposed on the panel substrate shown in FIG. 1. First to third color component signal lines ($R_1$, $G_1$, $B_1$) to ($R_N$, $G_N$, $B_N$) (first to third color component signal lines make a set) which are arranged in the X direction and extend in the Y direction are formed on the panel substrate.

R pixels (first color component pixels) PR ($PR_{11}$ to $PR_{MN}$) are formed at intersecting points of the scanning lines $GL_1$ to $GL_M$ and the first color component signal lines $R_1$ to $R_N$. G pixels (second color component pixels) PG ($PG_{11}$ to $PG_{MN}$) are formed at intersecting points of the scanning lines $GL_1$ to $GL_M$ and the second color component signal lines $G_1$ to $G_N$. B pixels (third color component pixels) PB ($PB_{11}$ to $PB_{MN}$) are formed at intersecting points of the scanning lines $GL_1$ to $GL_M$ and the third color component signal lines $B_1$ to $B_N$.

Figure 2A:
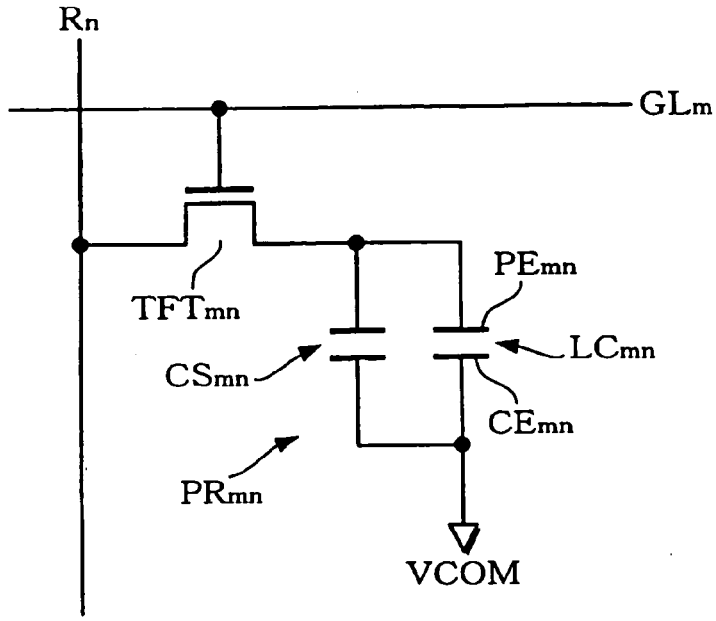
FIGS. 2A and 2B diagrams each showing a configuration of a color component pixel.
Figure 2B:
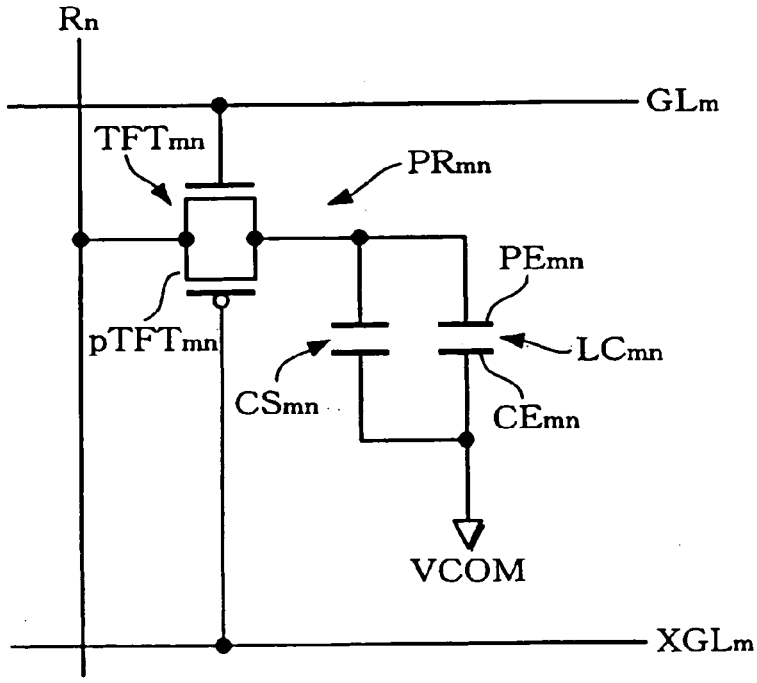

FIGS. 2A and 2B show configuration examples of the color component pixel. FIGS. 2A and 2B show configuration examples of the R pixel $PR_{mn}$($1 \leqq m \leqq M$, $1 \leqq 1 \leqq n \leqq N$, m and n are integers). Other color component pixels have the same configuration as the R pixel.

In FIG. 2A, the $TFT_{mn}$ as a first switching element SW1 is an n-type transistor. A gate electrode of the $TFT_{mn}$ is connected with the scanning line $GL_m$. A source electrode of the $TFT_{mn}$ is connected with the first color component signal line $R_n$. A drain electrode of the $TFT_{mn}$ is connected with the pixel electrode $PE_{mn}$. A common electrode $CE_{mn}$ mn is formed to face the pixel electrode $PE_{mn}$. A common voltage VCOM is applied to the common electrode $CE_{mn}$. A liquid crystal material is interposed between the pixel electrode $PE_{mn}$ and the common electrode $CE_{mn}$, whereby a liquid crystal layer $LC_{mn}$ is formed. The transmittance of the liquid crystal layer $LC_{mn}$ is changed corresponding to the voltage applied between the pixel electrode $PE_{mn}$ and the common electrode $CE_{mn}$. A storage capacitor $CS_{mn}$ is formed in parallel with the pixel electrode $PE_{mn}$ and the common electrode $CE_{mn}$ in order to compensate for charge leakage of the pixel electrode $PE_{mn}$. One end of the storage capacitor $CS_{mn}$ is set at the same potential as the pixel electrode $PE_{mn}$. The other end of the storage capacitor $CS_{mn}$ is set at the same potential as the common electrode $CE_{mn}$.

As shown in FIG. 2B, a transfer gate may be used as the first switching element SW1. The transfer gate is made up of an n-type transistor $TFT_{mn}$ and a p-type transistor $pTFT_{mn}$. A gate electrode of the $pTFT_{mn}$ must be connected with a scanning line $XGL_m$ of which the logic level is the inverse of that of the scanning line $GL_m$. In FIG. 2B, a configuration is employed in which an offset voltage corresponding to the voltage to be written is unnecessary.

In FIG. 1, a gate signal generation circuit 20 and demultiplexers $DMUX_1$ to $DMUX_N$ provided corresponding to each signal line are formed on the panel substrate.

The scanning lines $GL_1$ to $GL_M$ are connected with the gate signal generation circuit 20. A demultiplex control signal and a shift clock signal CPV are input to the gate signal generation circuit 20. The demultiplex control signal is a signal for controlling switching of each of the demultiplexers. The shift clock signal CPV is a clock signal which specifies timing for consecutively selecting the scanning lines $GL_1$ to $GL_M$.

The gate signal generation circuit 20 generates gate signals (select signals) $GATE_1$ to $GATE_M$ by using the shift clock signal CPV. The gate signals $GATE_1$ to $GATE_M$ are respectively output to the scanning lines $GL_1$ to $GL_M$. The gate signals $GATE_1$ to $GATE_M$ are pulse signals which exclusively go active in one frame of a vertical scanning period started by the start pulse signal.

In FIG. 1, the first to third switching elements SW1 to SW3 are switch-controlled (ON/OFF controlled) by the gate signal $GATE_m$ supplied to the scanning line $GL_m$. The color component signal line is electrically connected with the pixel electrode when the switching element is in an ON state.

The gate signals $GATE_1$ to $GATE_M$ are signals corresponding to shift output obtained by allowing a shift register to shift the start pulse signal, for example. The shift register includes a plurality of flip-flops, and performs a shift operation based on the shift clock signal input in common to each flip-flop. The start pulse signal is generated by the gate signal generation circuit 20 based on the demultiplex control signal.

The demultiplex control signal is supplied from a source driver (signal line driver circuit) provided outside the display panel 10, for example. The signal lines $SL_1$ to $SL_N$ are driven by the source driver (signal line driver circuit) provided outside the display panel 10, for example. The source driver outputs data signals corresponding to gray-scale data to each color component pixel. The source driver outputs voltages (data signals) which are time-divided for each color component pixel and correspond to the gray-scale data for each color component to each color component signal line. The source driver generates the demultiplex control signal for selectively outputting the voltages corresponding to the gray-scale data for each color component to each color component signal line in synchronization with the time-division timing, and outputs the demultiplex control signal to the display panel 10.

Figure 3:
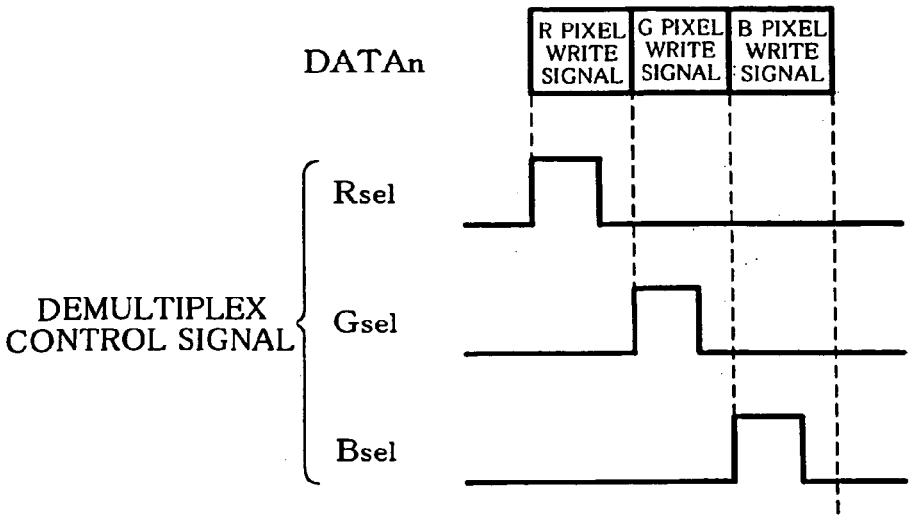
FIG. 3 is a schematic diagram showing the relation between a data signal output to a signal line and a demultiplex control signal.

FIG. 3 schematically shows the relation between the data signal output to the signal line by the source driver and the demultiplex control signal. FIG. 3 shows the data signal $DATA_n$ output to the signal line $SL_n$.

The source driver outputs the data signal in which the voltages corresponding to the gray-scale data (display data) for each color component are time-division multiplexed to each signal line. In FIG. 3, the source driver multiplexes a write signal to the R pixel, a write signal to the G pixel, and a write signal to the B pixel and outputs the multiplexed signal to the signal line $SL_n$. The write signal to the R pixel is a write signal to the R pixel $PR_{mn}$ selected by the scanning line $GL_m$ from the R pixels $PR_{1n}$ to $PR_{Mn}$ corresponding to the signal line $SL_n$, for example. The write signal to the G pixel is a write signal to the G pixel $PG_{mn}$ selected by the scanning line $GL_m$ from the G pixels $PG_{1n}$ to $PG_{Mn}$ corresponding to the signal line $SL_n$, for example. The write signal to the B pixel is a write signal to the B pixel $PB_{mn}$ selected by the scanning line $GL_m$ from the B pixels $PB_{1n}$ to $PB_{Mn}$ corresponding to the signal line $SL_n$, for example.

The source driver generates the demultiplex control signal in synchronization with the time-division timing of the write signals for each color component which are multiplexed into the data signal $DATA_n$. The demultiplex control signal includes first to third demultiplex control signals (Rsel, Gsel, Bsel).

The demultiplexer $DMUX_n$ corresponding to the signal line $SL_n$ is formed on the panel substrate. The demultiplexer $DMUX_n$ includes first to third (i=3) demultiplex switching elements DSW1 to DSW3.

The first to third color component signal lines ($R_n$, $G_n$, $B_n$) are connected with the output side of the demultiplexer $DMUX_n$. The signal line $SL_n$ is connected with the input side of the demultiplexer $DMUX_n$. The demultiplexer $DMUX_n$ electrically connects the signal line $SL_n$ with one of the first to third color component signal lines ($R_n$, $G_n$, $B_n$) in response to the demultiplex control signal. The demultiplex control signal is input in common to the demultiplexers $DMUX_1$ to $DMUX_N$.

The first demultiplex switching element DSW1 is ON/OFF controlled by the first demultiplex control signal Rsel. The second demultiplex switching element DSW2 is ON/OFF controlled by the second demultiplex control signal Gsel. The third demultiplex switching element DSW3 is ON/OFF controlled by the third demultiplex control signal Bsel. The first to third demultiplex control signals (Rsel, Gsel, Bsel) periodically and consecutively go active. Therefore, the demultiplexer $DMUX_n$ periodically and consecutively connects the signal line $SL_n$ electrically with the first to third color component signal lines ($R_n$, $G_n$, $B_n$).

In the display panel 10 having such a configuration, the time-divided voltages corresponding to the gray-scale data for the first to third color components are output to the signal line $SL_n$. In the demultiplexer $DMUX_n$, the voltages corresponding to the gray-scale data for each color component are applied to the first to third color component signal lines ($R_n$, $G_n$, $B_n$) by the first to third demultiplex control signals (Rsel, Gsel, Bsel) generated in synchronization with the time-division timing. The color component signal line is electrically connected with the pixel electrode in one of the first to third color component pixels ($PR_{mn}$, $PG_{mn}$, $PB_{mn}$) selected by the scanning line $GL_m$.

In FIG. 1, a circuit having a part or all of the function of the circuit which generates the shift clock signal or a part or all of the function of the source driver may be formed on the panel substrate of the display panel 10.

The function of the driver circuit of the display panel 10 is realized by a part or all of the circuit formed by the gate signal generation circuit 20, the demultiplexers $DMUX_1$ to $DMUX_N$, and the source driver having the above-described function.

The gate signal generation circuit 20 generates the gate signal as described below.

Figure 4:
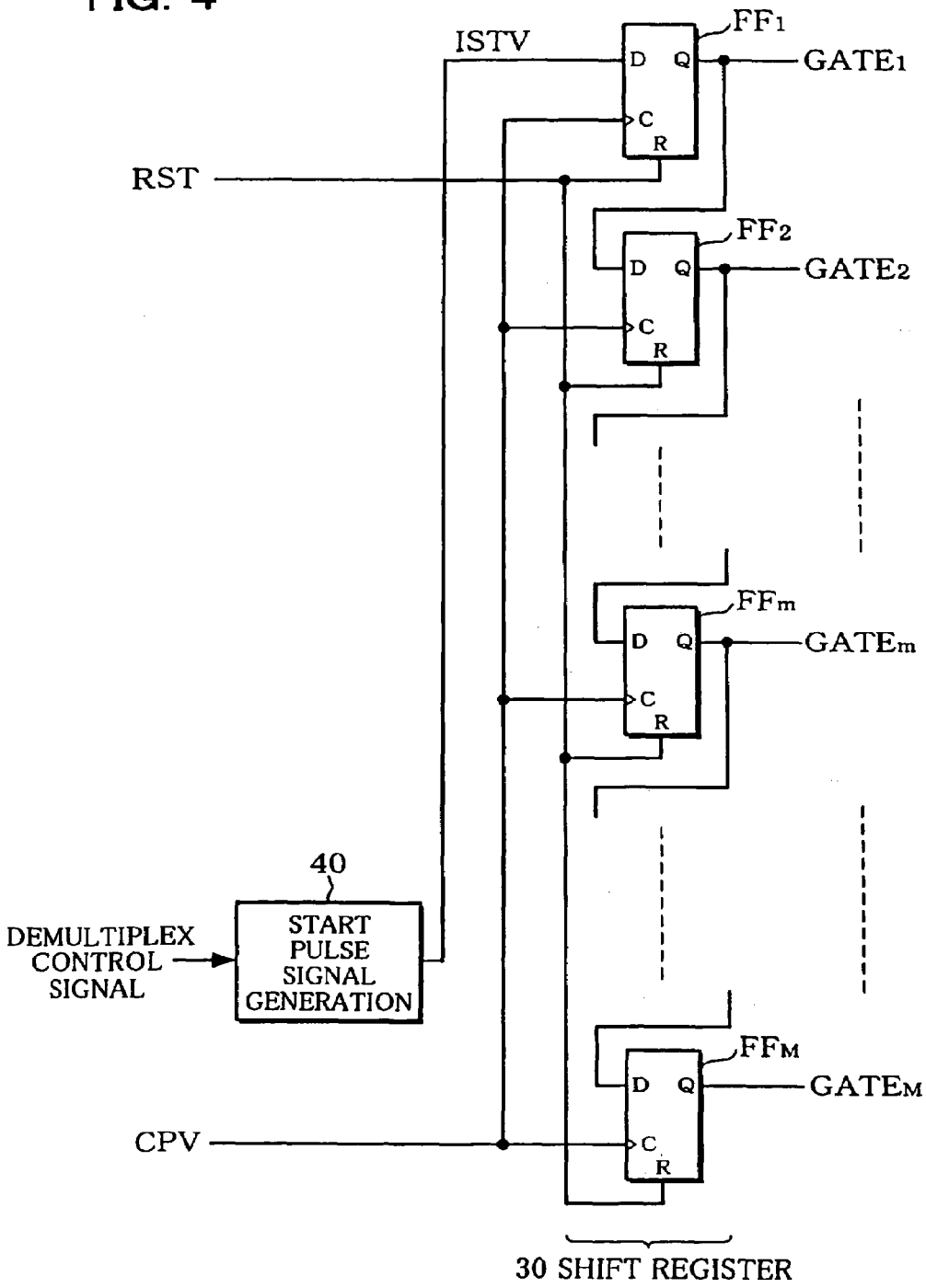
FIG. 4 is a circuit configuration diagram showing a configuration of a gate signal generation circuit.

FIG. 4 shows a configuration example of the gate signal generation circuit 20. The gate signal generation circuit 20 includes a shift register 30 and a start pulse signal generation circuit 40.

The shift register 30 includes a plurality of flip-flops $FF_1$ to $FF_M$. The output of the flip-flop $FF_p$($1 \leqq p \leqq M-1$, p is an integer) is connected with the input of the flip-flop $FF_{p+1}$ in the subsequent stage. The output of the flip-flop $FF_p$ is connected with the scanning line $GL_p$.

Each flip-flop includes an input terminal D, a clock signal input terminal C, an output terminal Q, and a reset terminal R. The flip-flop latches a signal input to the input terminal D at a rising edge of a signal input to the clock signal input terminal C. The flip-flop outputs the latched signal from the output terminal Q. The flip-flop initializes the latched content when the logic level of a signal input to the reset terminal R becomes "H", and sets the logic level of the signal output from the output terminal Q to "L".

The start pulse signal ISTV is input to the input terminal D of the flip-flop $FF_1$. A given reset signal RST is input in common to the reset terminals R of the flip-flops $FF_1$ to $FF_M$. The shift clock signal CPV is input to the clock signal input terminals C of the flip-flops $FF_1$ to $FF_M$.

The start pulse signal generation circuit 40 generates the start pulse signal ISTV based on the first to third demultiplex control signals (Rsel, Gsel, Bsel). The first to third demultiplex control signals (Rsel, Gsel, Bsel) control switching of the first to third demultiplex switching elements DSW1 to DSW3 so that the first to third demultiplex switching elements DSW1 to DSW3 are not set to an ON state at the same time. Therefore, the first to third demultiplex control signals (Rsel, Gsel, Bsel) essentially do not go active at the same time.

Therefore, the start pulse signal generation circuit 40 generates the start pulse signal ISTV when at least two of the first to third demultiplex control signals (Rsel, Gsel, Bsel) are active at the same time. This makes it possible to instruct the start timing of one frame of a vertical scanning period while maintaining the exclusive switch control function which should be performed by the first to third demultiplex control signals (Rsel, Gsel, Bsel). Therefore, it is unnecessary to externally generate the start pulse signal, whereby a signal input to the gate signal generation circuit 20 (display panel 10) can be made unnecessary.

Figure 5:
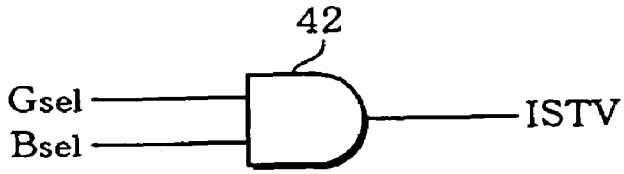
FIG. 5 is a circuit diagram showing a configuration of a start pulse signal generation circuit.

FIG. 5 shows a configuration example of the start pulse signal generation circuit 40. The start pulse signal generation circuit 40 includes a two-input, one-output AND gate 42. The second and third demultiplex control signals (Gsel, Bsel) are input to the AND gate 42. The start pulse signal ISTV is output from the output terminal of the AND gate 42. The AND gate 42 outputs the AND operation result of the second and third demultiplex control signals (Gsel, Bsel) from the output terminal.

In the shift register 30 having such a configuration, the output of each flip-flop is reset by the reset signal RST. The start pulse signal ISTV input to the flip-flop $FF_1$ is captured at a rising edge of the shift clock signal CPV, and shifted in synchronization with the shift clock signal CPV. The shift output from each flip-flop or a signal corresponding to the shift output is output to the scanning lines $GL_1$ to $GL_M$. This enables the gate signals $GATE_1$ to $GATE_M$ which select each scanning line to be output to the scanning lines $GL_1$ to $GL_M$.

Figure 6:
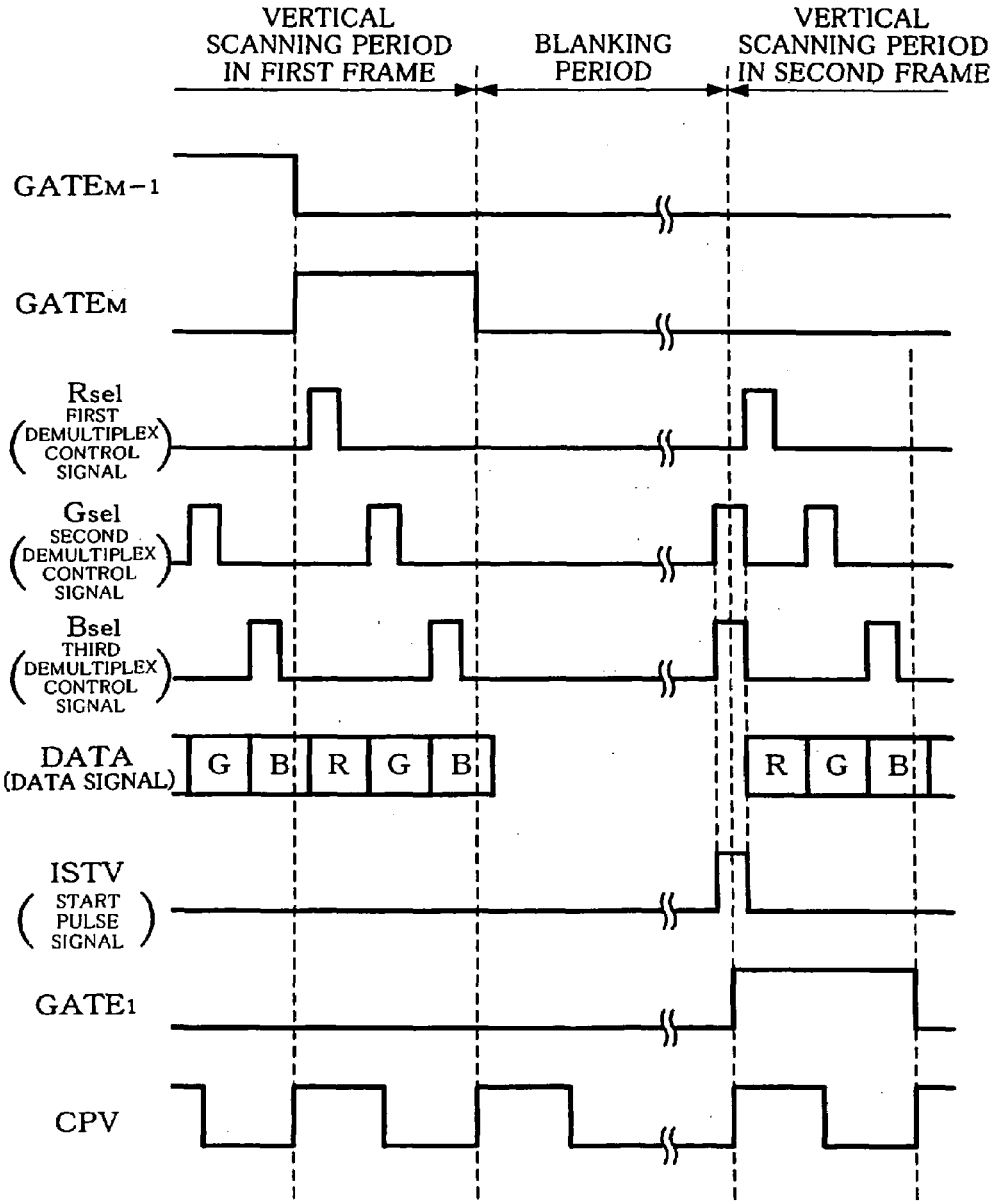
FIG. 6 is a timing chart showing an operation of a start pulse signal generation circuit.

FIG. 6 shows a timing chart of an operation example of the start pulse signal generation circuit 40. In this example, the start pulse signal ISTV is generated in a blanking period by allowing the second and third demultiplex control signals (Gsel, Bsel) to go active at the same time.

The blanking period is a period provided between the vertical scanning period in the first frame and the vertical scanning period in the second frame when the data signals are written in each pixel in the first frame and then written in each pixel in the second frame. The vertical scanning period includes a plurality of horizontal scanning periods. One of the scanning lines is selected in each horizontal scanning period.

In FIG. 6, provided that the first scanning line is a scanning line $GL_M$ and the second scanning line is a scanning line $GL_1$, the blanking period is provided between the vertical scanning period in the frame in which the scanning line $G_{LM}$ is selected and the vertical scanning period in the frame in which the scanning line $GL_1$ is selected.

The scanning lines $GL_1$ to $GL_M$ are consecutively selected in the first frame and the scanning lines $GL_1$ to $GL_M$ are consecutively selected in the second frame subsequent to the first frame. The select period of the scanning line $GL_M$ may be referred to as the last horizontal scanning period in the first frame. The select period of the scanning line $GL_1$ may be referred to as the first horizontal scanning period in the second frame.

In more detail, the blanking period is provided between the write period of each color component signal to the R pixels ($PR_{M1}$ to $PR_{MN}$), the G pixels ($PG_{M1}$ to $PG_{MN}$), and the B pixels ($PB_{M1}$ to $PB_{MN}$) connected with the scanning line $GL_M$ (first pixel group) and the write period of each color component signal to the R pixels ($PR_{11}$ to $PR_{1N}$), the G pixels ($PG_{11}$ to $PG_{1N}$), and the B pixels ($PB_{11}$ to $PB_{1N}$) connected with the scanning line $GL_1$ (second pixel group).

The reason that the start pulse signal ISTV is generated in the blanking period on condition that the second and third demultiplex control signals go active at the same time is because writing in the pixel in the blanking period does not directly affect the display quality. Specifically, although an unnecessary write operation is performed for a plurality of pixels by the demultiplex control signals which temporarily go active at the same time, the data signals are written in each color component pixel in the normal select period. Therefore, the image quality (display quality) does not deteriorate.

In this display panel, the data signals for each color component are written in each color component pixel by the first to third demultiplex control signals in the select period of each scanning line. The blanking period is provided after the select period of the scanning line $GL_M$. If the second and third demultiplex control signals (Gsel, Bsel) go active at the same time in the blanking period, the AND operation result of the second and third demultiplex control signals (Gsel, Bsel) is generated as the start pulse signal ISTV.

If the logic level of the start pulse signal ISTV is "H" at a rising edge of the shift clock signal CPV, the shift clock signal CPV is captured in the shift register 30. The gate signal is output to each scanning line by the shift operation in the shift register 30 in synchronization with the shift clock signal CPV.

The effect of the above embodiment is described below by comparing the display panel 10 with a display panel in a comparative example.

Figure 7:
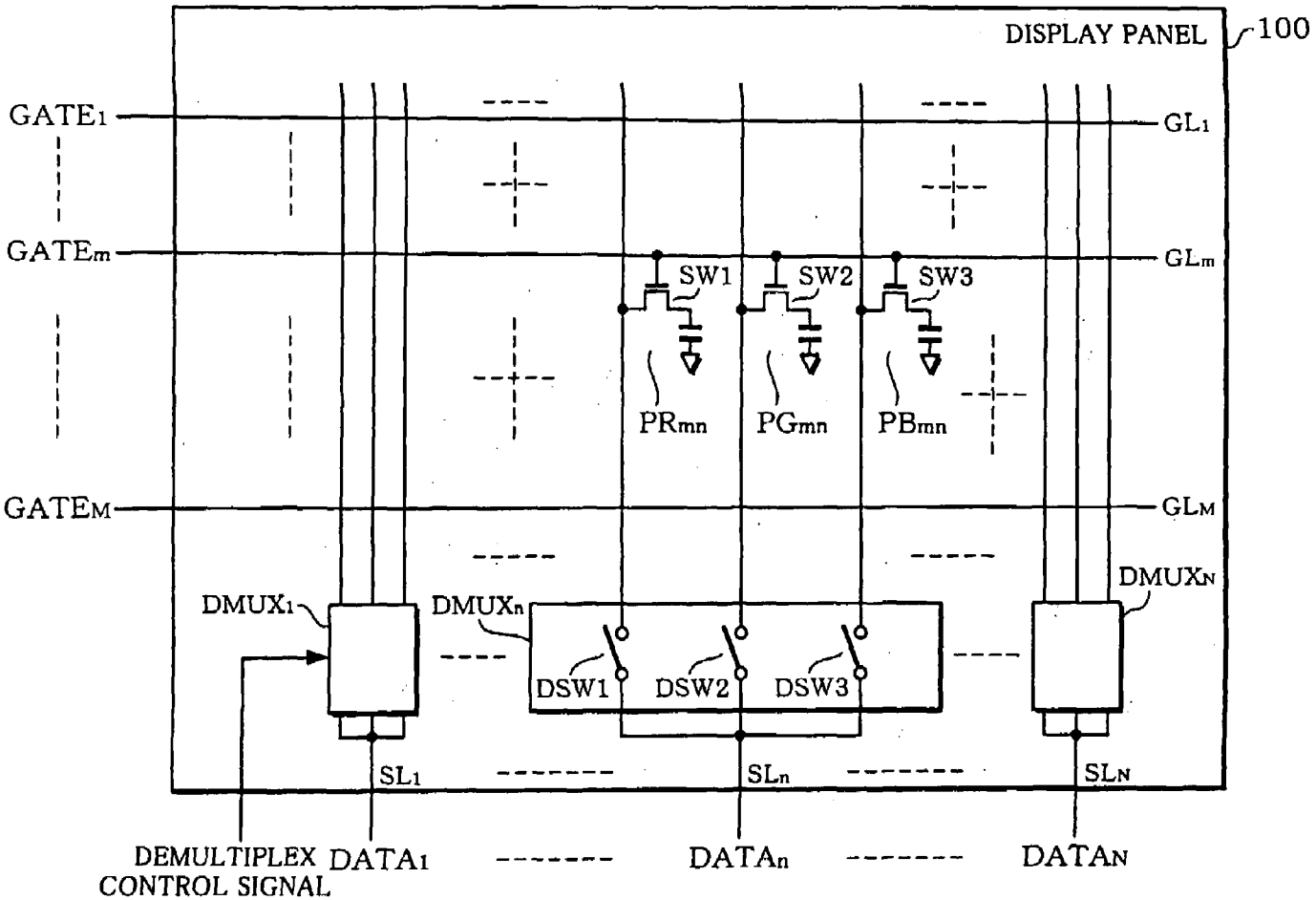
FIG. 7 is a diagram schematically showing a configuration of a comparative example of a display panel.

FIG. 7 shows an outline of a configuration of a display panel in the comparative example. In FIG. 7, sections the same as the sections of the display panel 10 shown in FIG. 1 are indicated by the same symbols. Description of these sections is appropriately omitted.

A display panel 100 in the comparative example differs from the display panel 10 shown in FIG. 1 in that the display panel 100 does not include the gate signal generation circuit 20. Therefore, in the display panel 100 in the comparative example, the gate signals $GATE_1$ to $GATE_M$ are respectively supplied to the scanning lines $GL_1$ to $GL_M$ by a gate driver (not shown) provided outside the display panel 100.

The operation timing of the display panel 100 in the comparative example is the same as the operation timing of the display panel 10 as to the start pulse signal ISTV, the gate signals $GATE_1$ to $GATE_M$, the first to third demultiplex control signals (Rsel, Gsel, Bsel), and the data signal (see FIG. 6).

However, if the number of terminals of the display panel 10 is compared with the number of terminals of the display panel 100, the number of terminals "M+3" is necessary for inputting the gate signals and the demultiplex control signals in the display panel 100.

Therefore, the number of terminals may be reduced by forming a circuit which generates the gate signals on the panel substrate which makes up the display panel 100. In this case, since the gate signal must be generated in synchronization with the output timing of the data signal, at least the start pulse signal and the shift clock signal are supplied from the outside of the display panel 100. Therefore, the number of terminals is reduced to "5" in the display panel 100 for inputting the start pulse signal, the shift clock signal, and the demultiplex control signals. It is difficult to form a complicated circuit such as the source driver on the panel substrate on which the circuit can be formed by using the LTPS process, taking the yield, circuit scale, speed, or cost into consideration.

In the display panel 10, the gate signal generation circuit 20 is formed on the panel substrate. Therefore, since the start pulse signal is generated by the gate signal generation circuit 20 in the display panel 10, the number of terminals can be reduced to "4" for inputting the shift clock signal and the demultiplex control signals. Therefore, power consumption can be further reduced.

The start pulse signal generation circuit 40 of the gate signal generation circuit 20 formed on the display panel on which the TFT is formed by using LTPS is not limited to the start pulse signal generation circuit shown in FIG. 5.

In FIG. 6, the start pulse signal ISTV is generated by using the second and third demultiplex control signals (Gsel, Bsel). However, the present invention is not limited thereto. It suffices that the start pulse signal generation circuit generate the start pulse signal ISTV on condition that at least two of the first to third demultiplex control signals go active at the same time.

Figure 8A:
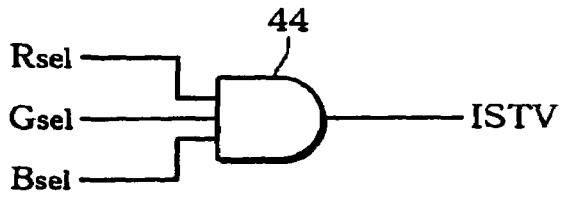
FIGS. 8A, 8B, and 8C are circuit diagrams showing another configuration of a start pulse signal generation circuit.
Figure 8B:
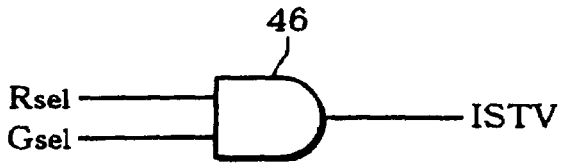
Figure 8C:
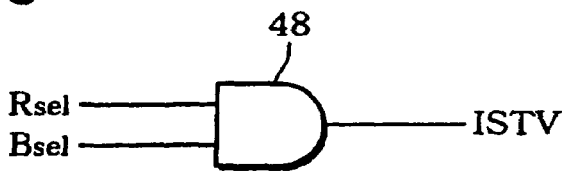

FIGS. 8A, 8B, and 8C show other configuration examples of the start pulse signal generation circuit 40. The start pulse signal generation circuit 40 shown in FIG. 8A includes a three-input, one-output AND gate 44. The first to third demultiplex control signals (Rsel, Gsel, Bsel) are input to the AND gate 44. The AND gate 44 outputs the AND operation result of the first to third demultiplex control signals (Rsel, Gsel, Bsel) from the output terminal. Therefore, the start pulse signal ISTV goes active when the first to third demultiplex control signals (Rsel, Gsel, Bsel) go active at the same time.

The start pulse signal generation circuit 40 shown in FIG. 8B includes a two-input, one-output AND gate 46. The first and second demultiplex control signals (Rsel, Gsel) are input to the AND gate 46. The AND gate 46 outputs the AND operation result of the first and second demultiplex control signals (Rsel, Gsel) from the output terminal. Therefore, the start pulse signal ISTV goes active when the first and second demultiplex control signals (Rsel, Gsel) go active at the same time.

The start pulse signal generation circuit 40 shown in FIG. 8C includes a two-input, one-output AND gate 48. The first and third demultiplex control signals (Rsel, Bsel) are input to the AND gate 48. The AND gate 48 outputs the AND operation result of the first and third demultiplex control signals (Rsel, Bsel) from the output terminal. Therefore, the start pulse signal ISTV goes active when the first and third demultiplex control signals (Rsel, Bsel) go active at the same time.

The first to third demultiplex control signals (Rsel, Gsel, Bsel) periodically go active in the order as described above. Therefore, after the first demultiplex control signal Rsel goes active in order to generate the start pulse signal ISTV, the first demultiplex control signal Rsel must go active immediately after the first select period of one frame of a vertical scanning period (select period by the gate signal $GATE_1$ in the vertical scanning period in the second frame shown in FIG. 6) has been started by the start pulse signal ISTV.

Therefore, the first demultiplex control signal Rsel must be generated at a timing more severe than those of the second and third demultiplex control signals (Gsel, Bsel). This tendency becomes more significant as the select period of the pixel is decreased accompanying an increase in the number of pixels. Therefore, when the first, second, and third demultiplex control signals (Rsel, Gsel, Bsel) go active in this order, it is preferable to generate the start pulse signal STV by using the demultiplex control signals other than the first demultiplex control signal Rsel as shown in FIG. 5, taking a decrease in the select period of the pixel into consideration.

Modification

Figure 9:
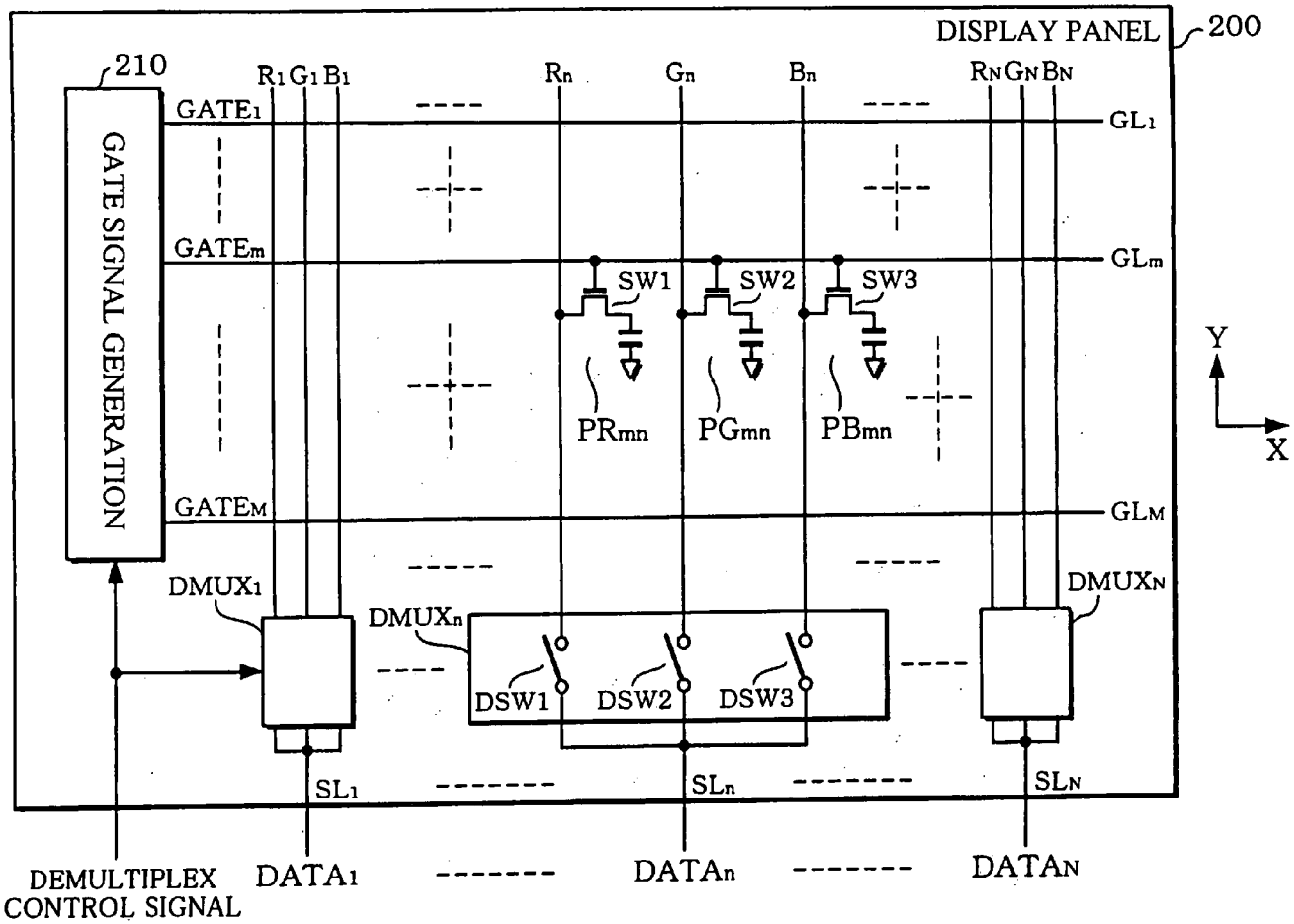
FIG. 9 is a diagram schematically showing a configuration of a display panel according to a modification of the embodiment.

FIG. 9 shows an outline of a configuration of a display panel according to a modification of the embodiment. In FIG. 9, sections the same as the sections of the display panel 10 shown in FIG. 1 are indicated by the same symbols. Description of these sections is appropriately omitted. A display panel 200 in this modification differs from the display panel 10 shown in FIG. 1 in that the display panel 200 includes a gate signal generation circuit 210 instead of the gate signal generation circuit 20.

The gate signal generation circuit 210 differs from the gate signal generation circuit 20 in that the gate signal generation circuit 210 is capable of generating the shift clock signal based on the demultiplex control signal.

According to this configuration, since it is unnecessary to externally input the shift clock signal to the display panel 200 in this modification, the number of terminals can be further reduced, whereby power consumption can be reduced.

Figure 10:
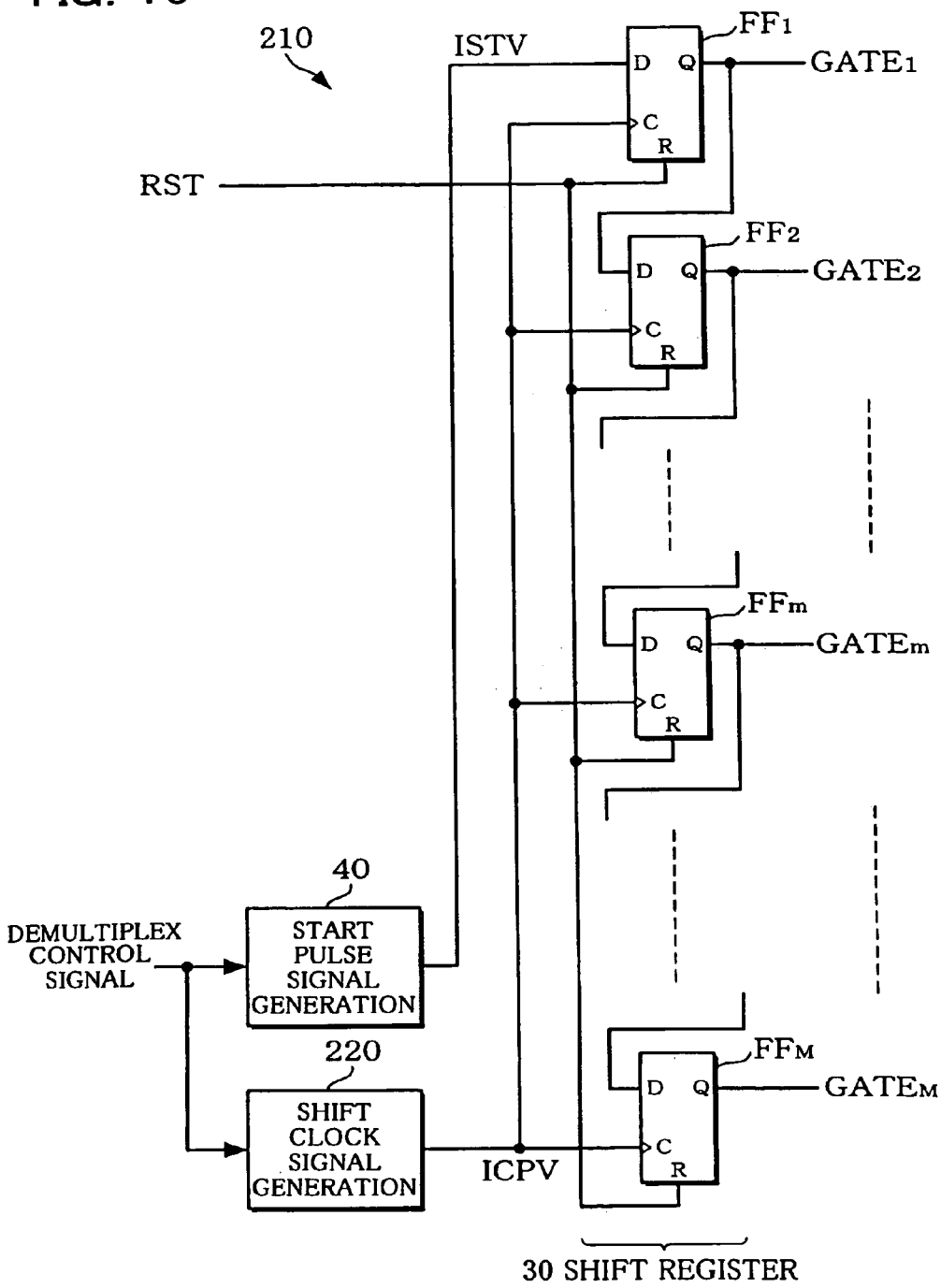
FIG. 10 is a circuit diagram showing a configuration of a gate signal generation circuit according to the modification.

FIG. 10 shows a configuration example of the gate signal generation circuit 210. In FIG. 10, sections the same as the sections of the gate signal generation circuit 20 shown in FIG. 4 are indicated by the same symbols. Description of these sections is appropriately omitted. The gate signal generation circuit 210 differs from the gate signal generation circuit 20 in that the gate signal generation circuit 210 includes a shift clock signal generation circuit 220. Therefore, the shift clock signal ICPV generated by the shift clock signal generation circuit 220 is input in common to the clock signal input terminals C of each flip-flop which makes up the shift register 30.

The shift clock signal generation circuit 220 generates the shift clock signal ICPV based on the demultiplex control signal.

Figure 11:
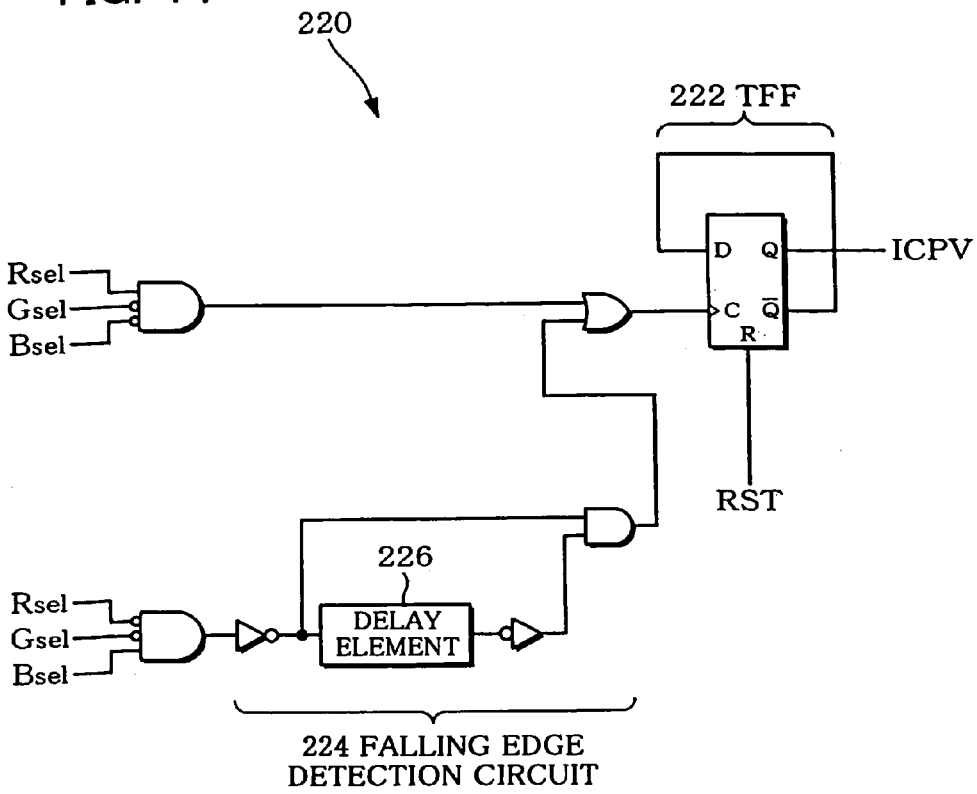
FIG. 11 is a circuit diagram showing a configuration of a shift clock signal generation circuit.

FIG. 11 shows a configuration example of the shift clock signal generation circuit 220. FIG. 11 shows a configuration example of a circuit which generates the shift clock signal by using the first and third demultiplex control signals (Rsel and Bsel) among the first to third demultiplex control signals (Rsel, Gsel, Bsel).

The shift clock generation circuit 220 includes a T flip-flop (TFF) 222 and a falling edge detection circuit 224. The TFF 222 inverts the logic level of the shift clock signal ICPV output from an output terminal Q at a rising edge of a signal input to the clock signal input terminal C. The TFF 222 sets the logic level of the signal output from the output terminal Q to "L" by a signal input to a reset input terminal R.

The falling edge detection circuit 224 detects a falling edge of the third demultiplex control signal Bsel. In more detail, the falling edge detection circuit 224 outputs a pulse signal of which the rising edge corresponds to a falling edge of the third demultiplex control signal Bsel. The pulse width of the pulse signal is determined depending on the delay time of a delay element 226.

The OR operation result of the first demultiplex control signal Rsel and the output of the falling edge detection circuit 224 is input to the input terminal C of the TFF 222.

The shift clock generation circuit 220 having such a configuration generates the shift clock signal ICPV of which the logic level is changed at a rising edge of the first demultiplex control signal Rsel. The shift clock generation circuit 220 generates the shift clock signal ICPV of which the logic level is changed at a falling edge of the third demultiplex control signal Bsel.

Figure 12:
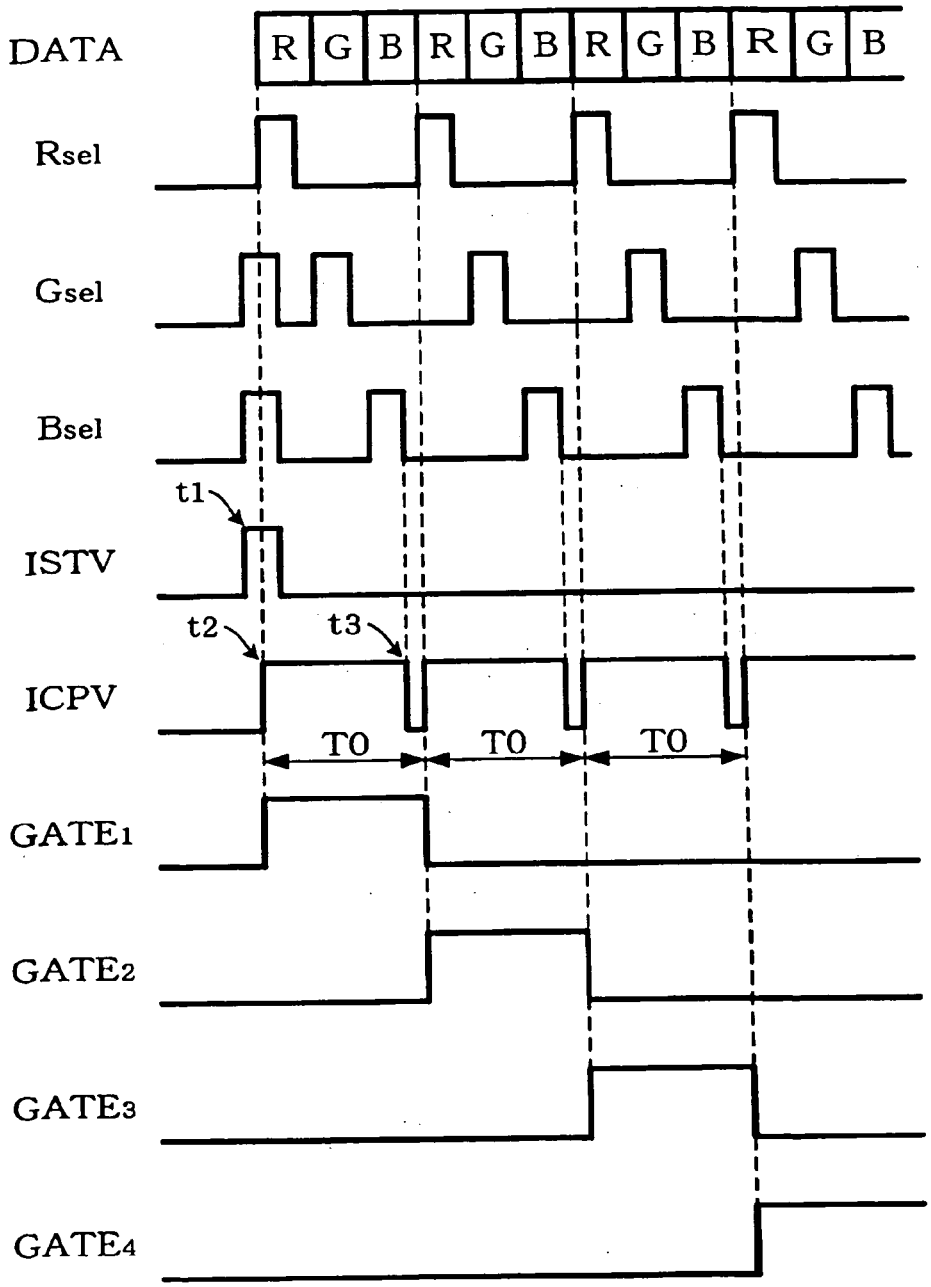
FIG. 12 is a timing chart showing an operation of a shift clock signal generation circuit according to the modification.

FIG. 12 shows a timing chart of an operation example of the gate signal generation circuit 210 in this modification. The TFF 222 of the shift clock signal generation circuit 220 is in a state in which the shift clock signal ICPV output from the output terminal Q is reset by the reset signal RST. The second and third demultiplex control signals (Gsel, Bsel) go active at the same time, whereby the logic level of the start pulse signal ISTV becomes "H" in the start pulse signal generation circuit 40 (t1).

The logic level of the output signal of the TFF 222 is inverted at a rising edge of the first demultiplex control signal Rsel, whereby the logic level of the shift clock signal ICPV becomes "H" (t2). This allows the start pulse signal ISTV to be captured by the flip-flop $FF_1$ of the shift register 30 at a rising edge of the shift clock signal ICPV, whereby the gate signal $GATE_1$ which indicates the select period of the scanning line $GL_1$ is output.

The logic level of the output signal of the TFF 222 is inverted at a falling edge of the third demultiplex control signal Bsel, whereby the logic level of the shift clock signal ICPV becomes "L" (t3).

In the TFF 222, the logic level of the output signal is repeatedly inverted at a rising edge of the first demultiplex control signal Rsel or a falling edge of the third demultiplex control signal Bsel.

As a result, the shift clock signal ICPV having a cycle of a period TO in which the first to third demultiplex control signals (Rsel, Gsel, Bsel) consecutively go active is generated. The shift operation is performed by the shift register 30 at a rising edge of the shift clock signal ICPV, whereby the gate signals $GATE_2$ to $GATE_M$ are sequentially output to the scanning lines $GL_2$ to $GL_M$.

In this modification, the falling edge detection circuit 224 detects the falling edge of the third demultiplex control signal Bsel. However, the present invention is not limited thereto. The same effect can be obtained by allowing the falling edge detection circuit 224 to detect the falling edge of the second demultiplex control signal Gsel.

The shift clock signal generation circuit 220 is not limited to the configuration shown in FIG. 11. The shift clock signal ICPV which is set by the first demultiplex control signal Rsel and reset by the second demultiplex control signal Gsel or the second demultiplex control signal Bsel may be generated by using an RS flip-flop. In this case, the shift clock signal having a cycle TO can also be generated.

The present invention is not limited to the above-described embodiment. Various modifications and variations are possible within the spirit and scope of the present invention.

The above-described embodiments illustrate the case where the pixels are selected in units of three pixels corresponding to each color component of R, G, and B. However, the present invention is not limited thereto. For example, the present invention can also be applied to the case where the pixels are selected in units of one, two, or four or more pixels.

The order in which the first to third demultiplex control signals (Rsel, Gsel, Bsel) periodically go active is not limited to that in the above embodiment.

Part of requirements of any claim of the present invention could be omitted from a dependent claim which depends on that claim. Moreover, part of requirements of any independent claim of the present invention could be made to depend on any other independent claim.

The following items are disclosed relating to the above-described embodiment.

One embodiment of the present invention relates to a driver circuit for driving an electro-optical device, wherein the electro-optical device comprises:

a plurality of scanning lines;

a plurality of signal lines, each of the signal lines transmitting a multiplexed data signal for first to third color components;

a plurality of pixels, each of the pixels being connected with one of the scanning lines and one of the signal lines; and a plurality of demultiplexers, each of the demultiplexers including first to third demultiplex switching elements which are respectively switch-controlled based on first to third demultiplex control signals, one end of each of the first to third demultiplex switching elements being connected with one of the signal lines and the other end of each of the first to third demultiplex switching elements being connected with one of the pixels for a j-th color component ($1 \leqq j \leqq 3$, j is an integer), wherein the driver circuit comprises a gate signal generation circuit which outputs a gate signal to each of the scanning lines, the gate signal corresponding to shift output obtained by shifting a start pulse signal, and wherein the gate signal generation circuit comprises a start pulse signal generation circuit which generates the start pulse signal on condition that at least two of the first to third demultiplex control signals go active at the same time.

In this embodiment, the electro-optical device includes a plurality of scanning lines; a plurality of signal lines, each of the signal lines transmitting a multiplexed data signal for first to third color components; a plurality of pixels, each of the pixels being specified by the scanning line and the signal line; and a plurality of demultiplexers, each of the demultiplexers including first to third demultiplex switching elements which are respectively switch-controlled based on the first to third demultiplex control signals, one end of each of the first to third demultiplex switching elements being connected with one of the signal lines and the other end of each of the first to third demultiplex switching elements being connected with one of the pixels for the j-th color component. Therefore, the data signal for the first to third color components output to the signal line by time division are selectively output by the first to third demultiplex control signals in a select period of each scanning line, and written in each pixel for each color component. Specifically, the first to third demultiplex control signals go active in the write period of the pixels.

In this embodiment, the start pulse signal generation circuit generates the start pulse signal on condition that at least two of the first to third demultiplex control signals go active at the same time. The start pulse signal generation circuit outputs the gate signal corresponding to the shift output obtained by shifting the start pulse signal to each of the scanning lines.

This makes it unnecessary to provide a terminal for inputting the start pulse signal by using an extremely simple configuration. In particular, since the number of terminals of the electro-optical device can be reduced when the electro-optical device and the driver circuit are formed on a single substrate, power consumption can be further reduced.

In the driver circuit according to this embodiment, when the data signal is written in each of the pixels in a first frame and then written in each of the pixels in a second frame after the first frame, the start pulse signal generation circuit may generate the start pulse signal on condition that at least two of the first to third demultiplex control signals go active at the same time in a blanking period provided between a vertical scanning period in the first frame and a vertical scanning period in the second frame.

In this embodiment, the start pulse signal is generated inside the driver circuit by allowing at least two of the first to third demultiplex control signals, which should not go active at the same time, to go active at the same time in the blanking period in which the display quality is not affected. The data signals are written in each of the pixels in the normal write period of the pixels. Therefore, the start pulse signal can be generated inside the driver circuit without causing the image quality to deteriorate, and an input terminal for the start pulse signal can be made unnecessary.

In the driver circuit according to this embodiment, when the first, second and third demultiplex control signals go active in this order in a period in which all of the pixels for the first to third color components are selected at the same time, the start pulse signal generation circuit may generate the start pulse signal on condition that the second and third demultiplex control signals go active at the same time.

When the first, second, and third demultiplex control signals go active in this order in a period in which all of the pixels for the first to third color components are selected at the same time, a case where the first demultiplex control signal is used to generate the start pulse signal is considered below. In this case, after generating the start pulse signal by allowing the first demultiplex control signal to go active, the first demultiplex control signal must go active immediately after the initial select period of a vertical scanning period for one frame has been started by the start pulse signal. Therefore, generation time for the first demultiplex control signal may be shorter than that for the second and third demultiplex control signals. This tendency becomes more significant as the select period of the pixel is decreased accompanying an increase in the number of pixels.

In this embodiment, since the start pulse signal is generated by using the second and third demultiplex control signals rather than the first demultiplex control signal, a driver circuit capable of reducing the number of terminals, even if the select period of the pixel is decreased, can be provided.

Another embodiment of the present invention relates to an electro-optical device comprising:

a plurality of scanning lines;

a plurality of signal lines, each of the signal lines transmitting a multiplexed data signal for first to third color components;

a plurality of pixels, each of the pixels being connected with one of the scanning lines and one of the signal lines; and a plurality of demultiplexers, each of the demultiplexers including first to third demultiplex switching elements which are respectively switch-controlled based on first to third demultiplex control signals, one end of each of the first to third demultiplex switching elements being connected with one of the signal lines and the other end of each of the first to third demultiplex switching elements being connected with one of the pixels for a j-th color component ($1 \leqq j \leqq 3$, j is an integer); and a gate signal generation circuit which outputs a gate signal corresponding to shift output obtained by shifting a start pulse signal to each of the scanning lines, wherein the gate signal generation circuit comprises a start pulse signal generation circuit which generates the start pulse signal on condition that at least two of the first to third demultiplex control signals go active at the same time.

In the electro-optical device according to this embodiment, when the data signal is written in each of the pixels in a first frame and then written in each of the pixels in a second frame after the first frame, the start pulse signal generation circuit may generate the start pulse signal on condition that at least two of the first to third demultiplex control signals go active at the same time in a blanking period provided between a vertical scanning period in the first frame and a vertical scanning period in the second frame.

In the electro-optical device according to this embodiment, when the first, second and third demultiplex control signals go active in this order in a period in which all of the pixels for the first to third color components are selected at the same time, the start pulse signal generation circuit may generate the start pulse signal on condition that the second and third demultiplex control signals go active at the same time.

A further embodiment of the present invention relates to a drive method for driving an electro-optical device, wherein the electro-optical device comprises:

a plurality of scanning lines;

a plurality of signal lines, each of the signal lines transmitting a multiplexed data signal for first to third color components;

a plurality of pixels, each of the pixels being connected with one of the scanning lines and one of the signal lines; and a plurality of demultiplexers, each of the demultiplexers including first to third demultiplex switching elements which are respectively switch-controlled based on first to third demultiplex control signals, one end of each of the first to third demultiplex switching elements being connected with one of the signal lines and the other end of each of the first to third demultiplex switching elements being connected with one of the pixels for a j-th color component ($1 \leqq j \leqq 3$, j is an integer), and wherein the method comprises:

generating a start pulse signal on condition that at least two of the first to third demultiplex control signals go active at the same time; and outputting a gate signal corresponding to shift output obtained by shifting the start pulse signal to each of the scanning lines.

The drive method according to this embodiment may comprise generating the start pulse signal on condition that at least two of the first to third demultiplex control signals go active at the same time in a blanking period provided between a vertical scanning period in a first frame and a vertical scanning period in a second frame, when the data signal is written in each of the pixels in the first frame and then written in each of the pixels in the second frame after the first frame.

The drive method according to this embodiment may comprise generating the start pulse signal on condition that the second and third demultiplex control signals go active at the same time, when the first, second and third demultiplex control signals go active in this order in a period in which all of the pixels for the first to third color components are selected at the same time.

What is claimed is:

1. A driver circuit for driving an electro-optical device, wherein the electro-optical device comprises:

a plurality of scanning lines;

a plurality of signal lines, each of the signal lines transmitting a multiplexed data signal for first to third color components;

a plurality of pixels, each of the pixels being connected with one of the scanning lines and one of the signal lines; and a plurality of demultiplexers, each of the demultiplexers including first to third demultiplex switching elements which are respectively switch-controlled based on first to third demultiplex control signals, one end of each of the first to third demultiplex switching elements being connected with one of the signal lines and the other end of each of the first to third demultiplex switching elements being connected with one of the pixels for a j-th color component ($1 \leqq j \leqq 3$, j is an integer), wherein the driver circuit comprises a gate signal generation circuit which outputs a gate signal to each of the scanning lines, the gate signal corresponding to shift output obtained by shifting a start pulse signal, and wherein the gate signal generation circuit comprises a start pulse signal generation circuit which generates the start pulse signal on condition that at least two of the first to third demultiplex control signals go active at the same time.

2. The driver circuit as defined in claim 1, wherein, when the data signal is written in each of the pixels in a first frame and then written in each of the pixels in a second frame after the first frame, the start pulse signal generation circuit generates the start pulse signal on condition that at least two of the first to third demultiplex control signals go active at the same time in a blanking period provided between a vertical scanning period in the first frame and a vertical scanning period in the second frame.

3. The driver circuit as defined in claim 1, wherein, when the first, second and third demultiplex control signals go active in this order in a period in which all of the pixels for the first to third color components are selected at the same time, the start pulse signal generation circuit generates the start pulse signal on condition that the second and third demultiplex control signals go active at the same time.

4. The driver circuit as defined in claim 2, wherein, when the first, second and third demultiplex control signals go active in this order in a period in which all of the pixels for the first to third color components are selected at the same time, the start pulse signal generation circuit generates the start pulse signal on condition that the second and third demultiplex control signals go active at the same time.

5. An electro-optical device comprising:

a plurality of scanning lines;

a plurality of signal lines, each of the signal lines transmitting a multiplexed data signal for first to third color components;

a plurality of pixels, each of the pixels being connected with one of the scanning lines and one of the signal lines; and a plurality of demultiplexers, each of the demultiplexers including first to third demultiplex switching elements which are respectively switch-controlled based on first to third demultiplex control signals, one end of each of the first to third demultiplex switching elements being connected with one of the signal lines and the other end of each of the first to third demultiplex switching elements being connected with one of the pixels for a j-th color component ($1 \leqq j \leqq 3$, j is an integer); and a gate signal generation circuit which outputs a gate signal corresponding to shift output obtained by shifting a start pulse signal to each of the scanning lines, wherein the gate signal generation circuit comprises a start pulse signal generation circuit which generates the start pulse signal on condition that at least two of the first to third demultiplex control signals go active at the same time.

6. The electro-optical device as defined in claim 5, wherein, when the data signal is written in each of the pixels in a first frame and then written in each of the pixels in a second frame after the first frame, the start pulse signal generation circuit generates the start pulse signal on condition that at least two of the first to third demultiplex control signals go active at the same time in a blanking period provided between a vertical scanning period in the first frame and a vertical scanning period in the second frame.

7. The electro-optical device as defined in claim 5, wherein, when the first, second and third demultiplex control signals go active in this order in a period in which all of the pixels for the first to third color components are selected at the same time, the start pulse signal generation circuit generates the start pulse signal on condition that the second and third demultiplex control signals go active at the same time.

8. The electro-optical device as defined in claim 6, wherein, when the first, second and third demultiplex control signals go active in this order in a period in which all of the pixels for the first to third color components are selected at the same time, the start pulse signal generation circuit generates the start pulse signal on condition that the second and third demultiplex control signals go active at the same time.

9. A drive method for driving an electro-optical device, wherein the electro-optical device comprises:

a plurality of scanning lines;

a plurality of signal lines, each of the signal lines transmitting a multiplexed data signal for first to third color components;

a plurality of pixels, each of the pixels being connected with one of the scanning lines and one of the signal lines; and a plurality of demultiplexers, each of the demultiplexers including first to third demultiplex switching elements which are respectively switch-controlled based on first to third demultiplex control signals, one end of each of the first to third demultiplex switching elements being connected with one of the signal lines and the other end of each of the first to third demultiplex switching elements being connected with one of the pixels for a j-th color component ($1 \leqq j \leqq 3$, j is an integer), and wherein the method comprises:

generating a start pulse signal on condition that at least two of the first to third demultiplex control signals go active at the same time; and outputting a gate signal corresponding to shift output obtained by shifting the start pulse signal to each of the scanning lines.

10. The drive method as defined in claim 9, comprising:

generating the start pulse signal on condition that at least two of the first to third demultiplex control signals go active at the same time in a blanking period provided between a vertical scanning period in a first frame and a vertical scanning period in a second frame, when the data signal is written in each of the pixels in the first frame and then written in each of the pixels in the second frame after the first frame.

11. The drive method as defined in claim 9, comprising:

generating the start pulse signal on condition that the second and third demultiplex control signals go active at the same time, when the first, second and third demultiplex control signals go active in this order in a period in which all of the pixels for the first to third color components are selected at the same time.

12. The drive method as defined in claim 10, comprising:

generating the start pulse signal on condition that the second and third demultiplex control signals go active at the same time, when the first, second and third demultiplex control signals go active in this order in a period in which all of the pixels for the first to third color components are selected at the same time.

* * * * *